US007193489B2

(12) United States Patent
Kornowski et al.

(10) Patent No.: US 7,193,489 B2
(45) Date of Patent: Mar. 20, 2007

(54) RADIO FREQUENCY CAVITY RESONATOR WITH HEAT TRANSPORT APPARATUS

(75) Inventors: Robert R. Kornowski, Schaumburg, IL (US); Robert A. Richter, Jr., Lake in the Hills, IL (US)

(73) Assignee: Motorola, Inc., Schaumburg, IL (US)

( * ) Notice: Subject to any disclaimer, the term of this patent is extended or adjusted under 35 U.S.C. 154(b) by 34 days.

(21) Appl. No.: 11/004,328

(22) Filed: Dec. 3, 2004

(65) Prior Publication Data

US 2006/0119454 A1 Jun. 8, 2006

(51) Int. Cl.
*H01P 1/30* (2006.01)
*H01P 7/06* (2006.01)

(52) U.S. Cl. ..... 333/229; 333/219.1; 333/232; 333/234

(58) Field of Classification Search ..... 333/202, 333/219.1, 229, 231, 232, 234, 235
See application file for complete search history.

(56) References Cited

U.S. PATENT DOCUMENTS 2,471,744 A 5/1949 Hershberger
3,935,552 A 1/1976 Hutcheon
5,111,170 A 5/1992 Ohya
5,748,060 A * 5/1998 Sarkka ..... 333/235
5,902,404 A 5/1999 Fong
5,909,160 A * 6/1999 Dick et al. ..... 333/234
5,677,653 A1 4/2001 Akesson

* cited by examiner

*Primary Examiner*—Seungsook Ham
(74) *Attorney, Agent, or Firm*—Valerie M. Davis

(57) ABSTRACT

An RF cavity resonator (400) that includes: a resonator chamber (410) for containing an RF field; an RF coupling element (450, 452) coupled to the resonator chamber for introducing the RF field into and extracting the RF field from the resonator chamber; a tuning assembly (420) for causing the RF field to resonate at a desired frequency, wherein at least a portion of the tuning assembly is coupled within the resonator chamber; and a heat transport element (440) for transporting heat from the RF cavity resonator, wherein at least a portion of the heat transport element is coupled within the resonator chamber, the heat transport element including a phase change material, a housing for enclosing the phase change material, means for circulating the phase change material within the housing, and an electrically conductive surface for isolating the phase change material from the RF field.

16 Claims, 5 Drawing Sheets

100

400

700

RADIO FREQUENCY CAVITY RESONATOR WITH HEAT TRANSPORT APPARATUS

FIELD OF THE INVENTION

The present invention relates generally to radio frequency (RF) cavity resonators and more specifically to an RF cavity resonator having heat transport apparatus.

BACKGROUND OF THE INVENTION

RF cavity resonators are used in a variety of applications including amplifiers, filters and oscillators. As filters, RF cavity resonators may be used in devices such as transmitters and receivers. When used in high power applications, such as in transmitters, some of the RF cavity resonator's elemental parts are typically subject to extreme temperature variations. For instance, as power is introduced into the RF cavity resonator, these elemental parts may heat up to temperatures that adversely affect the performance of the RF cavity resonator. This will typically cause the resonant frequency of the RF cavity resonator to become unstable, thereby affecting the performance of an RF device that incorporates the RF cavity resonator. If the RF cavity resonator is also operating in high ambient temperatures, this will worsen the stability problem. Moreover, in a worst case scenario, the elemental components of the RF cavity resonator may heat to the point of failure.

To address the instability of RF cavity resonators under high power and high ambient temperature conditions, RF device designers may compromise between the power handling capability and operating temperature of a product that incorporates the RF cavity resonator. However, this in turn leads to a compromise in the performance specifications of the product. Known temperature compensation techniques may also be utilized in the RF cavity resonator design. However, these techniques may utilize extruded heat sinks that appreciably increase the size and weight of the product. Moreover, these design techniques typically result in an increased design cycle time and may also require significant preconditioning during the manufacturing process that increases the end-product cost. In addition, conventional temperature compensation techniques, in general, do not provide a solution for the entire operating range of the product.

Thus, there exists a need for an RF cavity resonator that includes a heat transport mechanism. It is desirable that the heat transport mechanism neither compromise the operating range of the RF cavity resonator, nor appreciably increase the size, cost or design cycle time of the device incorporating the RF cavity resonator.

BRIEF DESCRIPTION OF THE FIGURES

A preferred embodiment of the invention is now described, by way of example only, with reference to the accompanying figures in which.

DETAILED DESCRIPTION OF THE INVENTION

Figure 1:
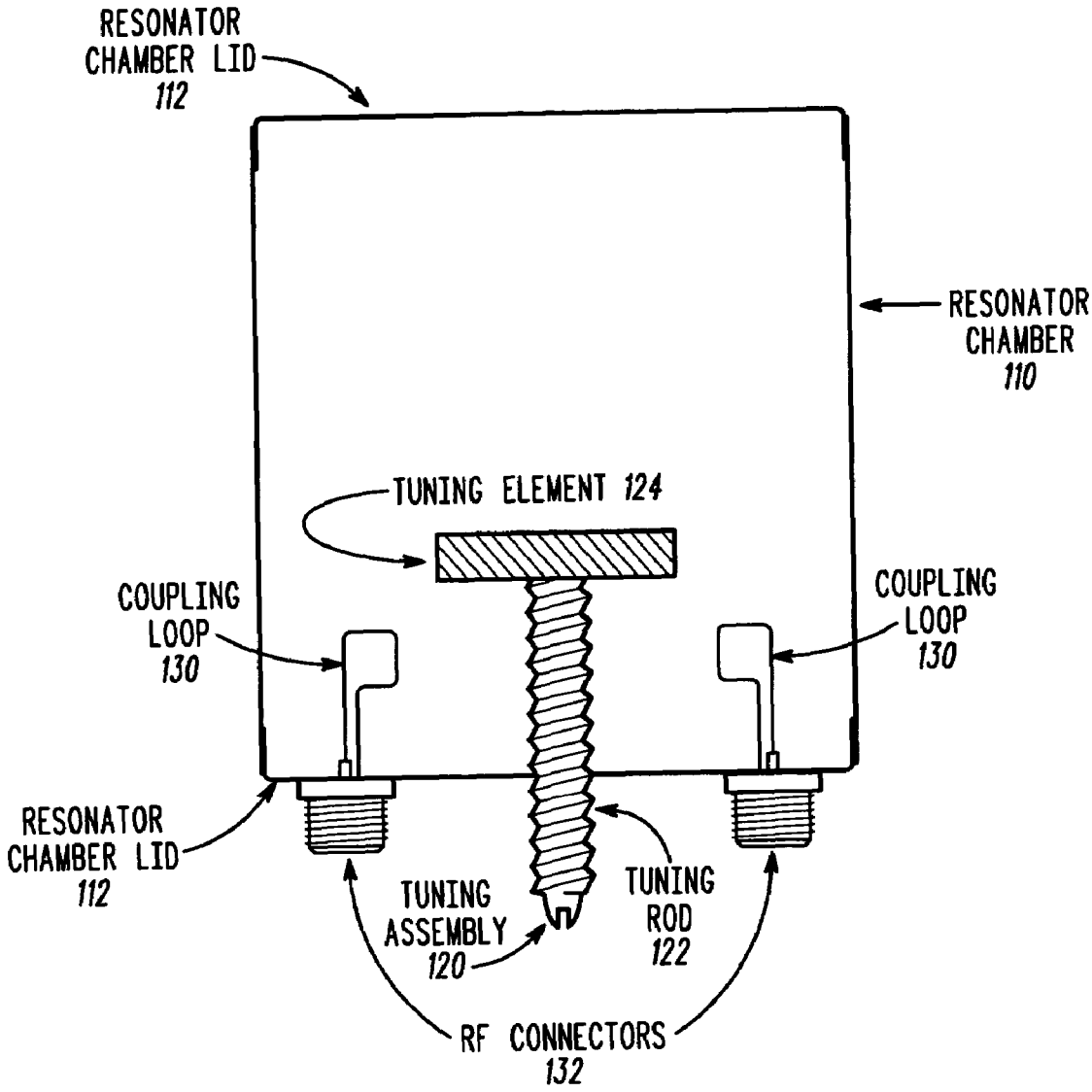
FIG. 1 illustrates a cross-sectional view of an RF cavity resonator in accordance with an embodiment of the present invention.

While this invention is susceptible of embodiments in many different forms, there are shown in the figures and will herein be described in detail specific embodiments, with the understanding that the present disclosure is to be considered as an example of the principles of the invention and not intended to limit the invention to the specific embodiments shown and described. Further, the terms and words used herein are not to be considered limiting, but rather merely descriptive. It will also be appreciated that for simplicity and clarity of illustration, elements shown in the figures have not necessarily been drawn to scale. For example, the dimensions of some of the elements are exaggerated relative to each other. Further, where considered appropriate, reference numerals have been repeated among the figures to indicate corresponding elements.

FIG. 1 illustrates a cross-sectional view of an RF cavity resonator 100 in accordance with an embodiment of the present invention. RF cavity resonator 100 comprises a resonator chamber 110 typically having lids 112. Inside of resonator chamber 110 is a cavity for containing an RF field having a given resonant frequency. The resonator chamber may be formed from any suitable material such as, for instance, Copper, Aluminum or any substance with an electrically conductive surface, including metallized plastic. The lids 112 may be attached to the resonator chamber using any suitable means including, for example, soldering and/or riveting the lids to the resonant chamber.

The resonant frequency of the RF cavity resonator is strongly dependent on the geometry of the resonator chamber. Accordingly, it is difficult to manufacture a resonator chamber with a precise resonant frequency. Also, there exists a need for an end-user to be able to adjust the resonant frequency of the cavity to comply with a given assigned operating frequency. Therefore, RF cavity resonator 100 further comprises a tuning assembly 120 that includes a collection of elements for adjusting the resonant frequency of the resonator chamber 110 such that the RF field in the chamber resonates at a desired frequency. Illustrated in FIG. 1 as elements of the tuning assembly 120 is a tuning rod 122, a portion of which extends into the resonator chamber and a tuning element 124 coupled to an end of the tuning rod that is within the resonator chamber. Typically, tuning element 124 has a flat shape, such as a capacitance disk. However, those of ordinary skill in the art will realize that the tuning element 124 may have a different shape such as parabolic, wherein the shape of the tuning element 124 depends on operating requirements. Other elements of the tuning assembly 120 are not illustrated in FIG. 1 for ease of illustration, but will be described in detail by reference to FIG. 2. In this embodiment, adjusting the tuning assembly 120 adjusts tuning element 124 in and out with respect to the RF field in the resonator chamber 110, which adjusts the resonance of the resonator chamber to a desired frequency.

RF cavity resonator 100 further comprises an RF coupling element, which in this embodiment includes RF coupling loops 130 and RF connectors 132. Transmission Mode (two-port) RF cavity resonators employ RF connectors 132 with the electrically connected coupling loops 130 to introduce and extract the RF field to and from the resonator chamber 110. Reflection Mode (one-port) RF cavity resonators employ one RF connector 132 with one electrically connected coupling loop 130 by which the RF field is introduced into and extracted from the resonator chamber 110. The invention herein disclosed is applicable to both Transmission Mode and Reflection Mode RF cavity resonators. Those of ordinary skill in the art will realize that there are other embodiments of RF coupling elements for introducing and extracting the RF field into and from an RF cavity resonator, such as aperture-coupled elements or at least one microstrip element and at least one RF connector coupled to the microstrip element.

RF cavity resonator 100 includes a heat transport element in accordance with an embodiment of the present invention for transporting heat from the RF cavity resonator. Inclusion of this heat transport element enables RF cavity resonator functionality at higher levels of RF power, or higher ambient temperatures, or provides improved frequency stability and reliability at any level of RF power and ambient temperature. At least a portion of the heat transport element is operatively coupled within the resonator chamber 110, and the heat transport element comprises a phase change material, a housing for enclosing the phase change material, means for circulating the phase change material within the housing, and an electrically conductive surface for isolating the phase change material from the RF field. In the RF cavity resonator embodiment 100, the greatest heat flux due to power dissipation in the resonator cavity is typically in the tuning element 124. Thus, it is desirable that the heat transport element included in RF cavity resonator 100 effectively transport the resulting heat from the tuning element to the ambient air outside of the resonator chamber. This may be accomplished, for example, using an embodiment of a heat transport element incorporated into the tuning assembly as illustrated in FIG. 2.

Figure 2:
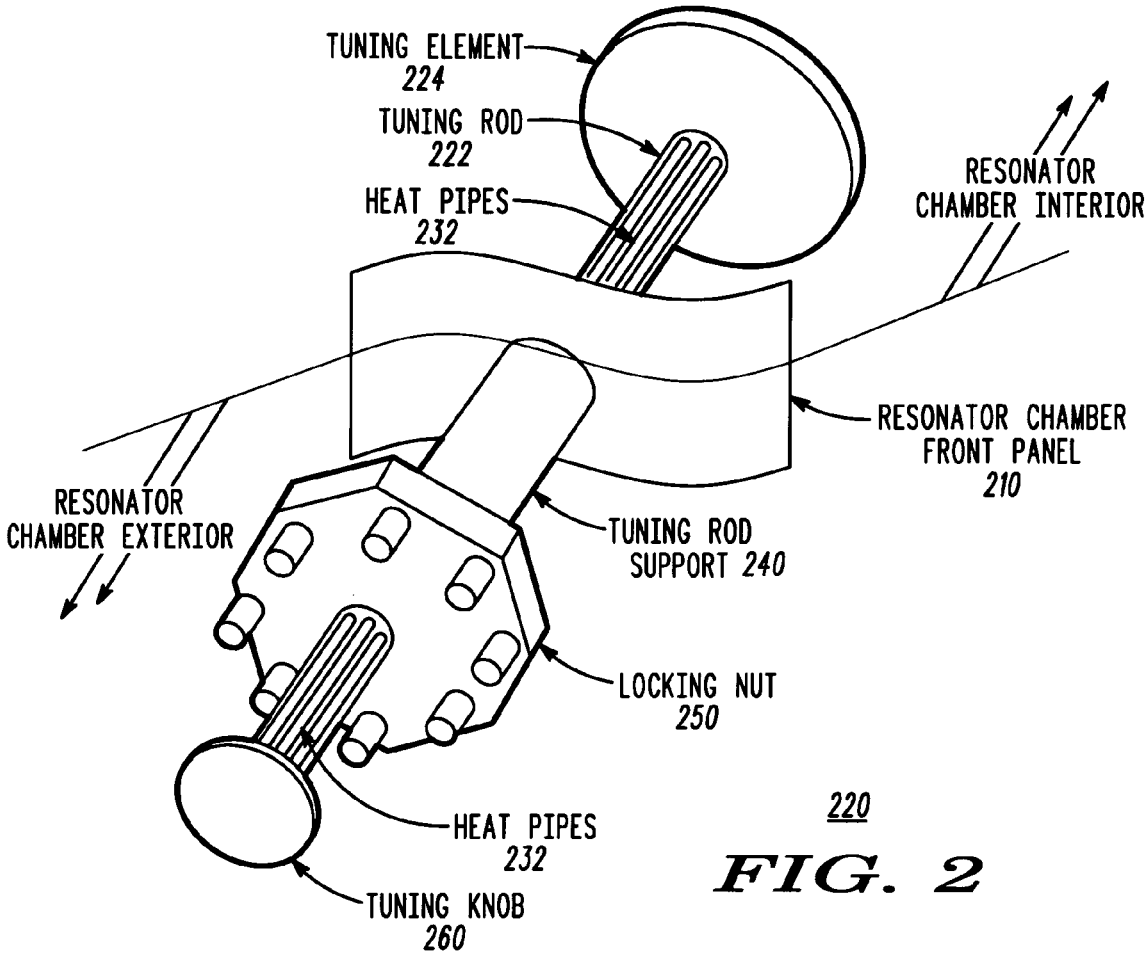
FIG. 2 illustrates an isometric view of a tuning assembly that incorporates heat pipes for transporting heat from the RF cavity resonator of FIG. 1.

FIG. 2 illustrates an isometric view of a tuning assembly 220 for use in the RF cavity resonator of FIG. 1, and that incorporates the heat transport element for RF cavity resonator 100. Tuning assembly 220 comprises the conventional elements of: a tuning rod 222 having a first end and a second end; a tuning element 224 coupled to the tuning rod 222 at the first end; a tuning rod support 240 surrounding at least a portion of the tuning rod 222; a locking nut 250 surrounding at least a portion of the tuning rod 222 and tightened against the tuning rod support 240 for locking the tuning element 224 into place once a desired resonant frequency is reached; and a tuning knob 260 coupled to the tuning rod 222 at the second end for adjusting the tuning element 224 in and out to reach the desired resonant frequency.

Tuning assembly 220 further comprises a heat transport element, for instance for RF cavity resonator 100, that includes at least one and in this embodiment a plurality of heat pipes 232. Heat pipes 232 are surrounded by tuning rod 222 and ideally extend from one end of the tuning rod to the other end, such that the heat pipes are oriented in the direction of desired heat transport. Heat pipes 232 may be any suitable heat pipes having a container or housing that is ideally leak-proof, a phase-change material within the container and a means for circulating the phase change material within the housing.

The housing may be constructed from materials such as, for instance, Copper, Copper alloy, Brass, Phosphor Bronze, Invar or any material with an electrically conductive surface including metallized plastic. Selection of material for the housing is a function of factors such as: compatibility with the phase change material and the environment external to the housing; strength to weight ratio; thermal conductivity; coefficient of thermal expansion; ease of fabrication, including welding, machineability and ductility; porosity; wettabilty, etc. The phase change material, in this embodiment, is typically a liquid that changes to gas (i.e., a liquid-to-gas material) during the heat transport process, and may be any suitable liquid-to-gas material such as, for instance, water, Freon, ammonia or a glycol formulation such as Ethylene Glycol or Propylene Glycol.

The means for circulating the phase change material within the housing may be any suitable means such as, for instance, gravity (depending on the orientation of the tuning element with respect to the area of heat flux) or a capillary feed device such as a wicking device that may be made of material such as steel, nickel, Aluminum, Copper, plastic, etc., having various ranges of pore size (that may be used independent of such orientation) or both. The primary function of the capillary feed device is to generate capillary pressure to circulate the phase change material within the housing.

A portion of the heat pipes extends into the interior of the resonator chamber front panel 210 and a portion is located external to the resonator chamber front panel 210 in order to transport heat from the interior of the resonator chamber typically to the ambient air on the exterior of the resonator chamber (or in other implementations into a heat sink or other heat dissipation element, etc.). Therefore, in this embodiment, since the area of greatest heat flux is generally the tuning element 224 the heat pipes are ideally coupled to the tuning element 224 to transport the heat from this element to the ambient air outside of the resonator chamber. Those of ordinary skill in the art will realize that in an alternative embodiment, the heat pipes may be extended into the tuning element 224 to further enhance heat transport from the tuning element 224.

The heat transport element illustrated in FIG. 2 further comprises an electrically conductive surface for isolating the phase change material from the RF field on the interior of the resonator chamber front panel 210. In this embodiment, at least the portion of the tuning rod 222 that extends into the interior of the resonator chamber front panel 210 may be made of a suitable material with an electrically conductive surface such as, for instance, a cast metal, a cast electrically and thermally conductive resin, a ceramic or combinations thereof. The housing for the heat pipes also or alternatively could be comprised of the same material as that of the electrically conductive surface. Since this electrically conductive surface isolates the phase change material from the RF field inside of the resonator chamber, the heat transport functionality is transparent to the RF cavity resonator functionality and does not disturb the resonator performance.

Figure 3:
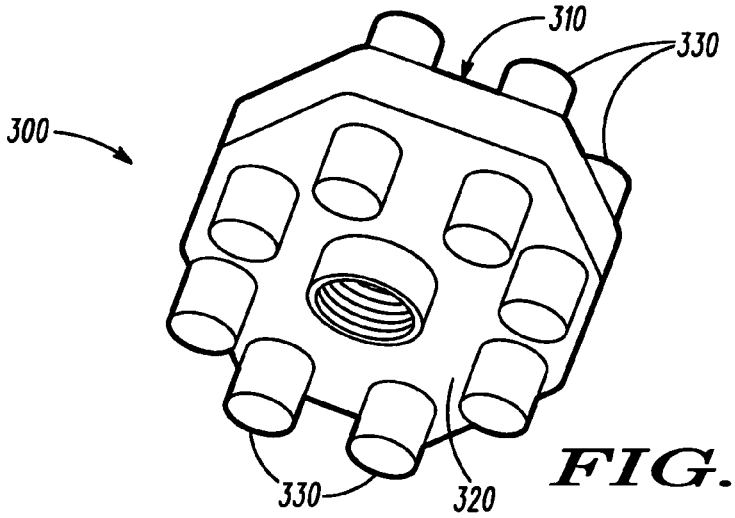
FIG. 3 illustrates an isometric view of a locking nut that may be included in the tuning assembly of FIG. 2.

Ideally, the heat transport element illustrated in FIG. 2 further comprises one or more surface expansion elements to further enhance heat transport into the ambient air outside of the resonator chamber. These surface expansion elements are shown (but not labeled) in FIG. 2 and are further illustrated in FIG. 3. Accordingly, FIG. 3 illustrates an isometric view of a locking nut 300 that may be included, for instance, in the tuning assembly of FIG. 2. Locking nut 300 is illustrated as having a top side 310 and a bottom side 320 and a plurality of surface expansion elements 330 that are ideally coupled through the top side 310 and bottom side 320 of the locking nut, for example using a press-fit procedure or a casting process. Alternatively, surface expansion elements 330 may be coupled to both the top side 310 and the bottom side 320 of the locking nut or to only one of the sides.

Moreover, the surface expansion elements (and the rest of the locking nut) may be manufactured from any suitable material such as, for instance, Copper, Copper alloy, etc. and have a size and shape that may depend on factors such as the surface area of the sides of the locking nut, the ability to effectively transport heat energy into the ambient air substantially independent of physical orientation, etc. In addition to simply increasing the surface area of the locking nut to affect greater heat transport into the ambient air, optimum surface expansion surface element design involves the implementation of surface contour and transitional radius to promote the uniform flow of ambient air over the expanded locking nut surface.

Those of ordinary skill in the art will realize that although FIG. 2 and FIG. 3 illustrates the heat transport element being incorporated into the locking nut, the heat transport element may be incorporated into any of the individual constituents of the tuning assembly that are external to the resonator chamber (i.e., the tuning knob, the tuning rod support or the locking nut or elements having a similar functionality) or any combination thereof. Those of ordinary skill in the art will further realize that instead of using heat pipes, in another embodiment of the present invention the heat transport element may be constructed by using the tuning rod as a housing having one or more hallowed chambers for containing the phase change material and the means for circulating the phase change material. Therefore, the portion of the housing that extends into the resonator chamber would typically be comprised of a suitable electrically conductive material or thermally conductive material with an electrically conductive surface. The tuning element may likewise be comprised of electrically conductive material and have one or more chambers for containing the phase change material and the accompanying means for circulating this material. Also, those of ordinary skill in the art will realize that the phase change material may alternatively be one that changes its phase during the heat transport process from a solid to a liquid or from a solid to a gas.

Finally, whereas FIG. 2 and FIG. 3 depict a manually tuned assembly and its related elements, the invention herein disclosed is equally applicable to Auto-tuned cavity resonator systems. In such an embodiment, a motor element, for example a stepper motor, may be included in the tuning assembly. The stepper motor may be used in conjunction with any combination of the tuning knob, tuning rod support and the locking nut, the simplest embodiment being where the locking nut is tightened against the tuning knob and the motor is coupled to the tuning knob, for instance, to drive the tuning element in and out within the resonator chamber. However, those of ordinary skill in the art will realize that in other embodiments, the stepper motor may replace the tuning knob, tuning rod support and the locking nut or any combination thereof. Wherein, if the locking nut is eliminated, the heat transport element is alternatively included in an element having similar heat dissipating capability as the locking nut, which may be coupled to the tuning motor and surround at least a portion of the tuning rod. For example, the heat transport element may have a similar design and heat dissipating functionality as a pedestal 734 described in detail below by reference to FIG. 7.

Figure 4:
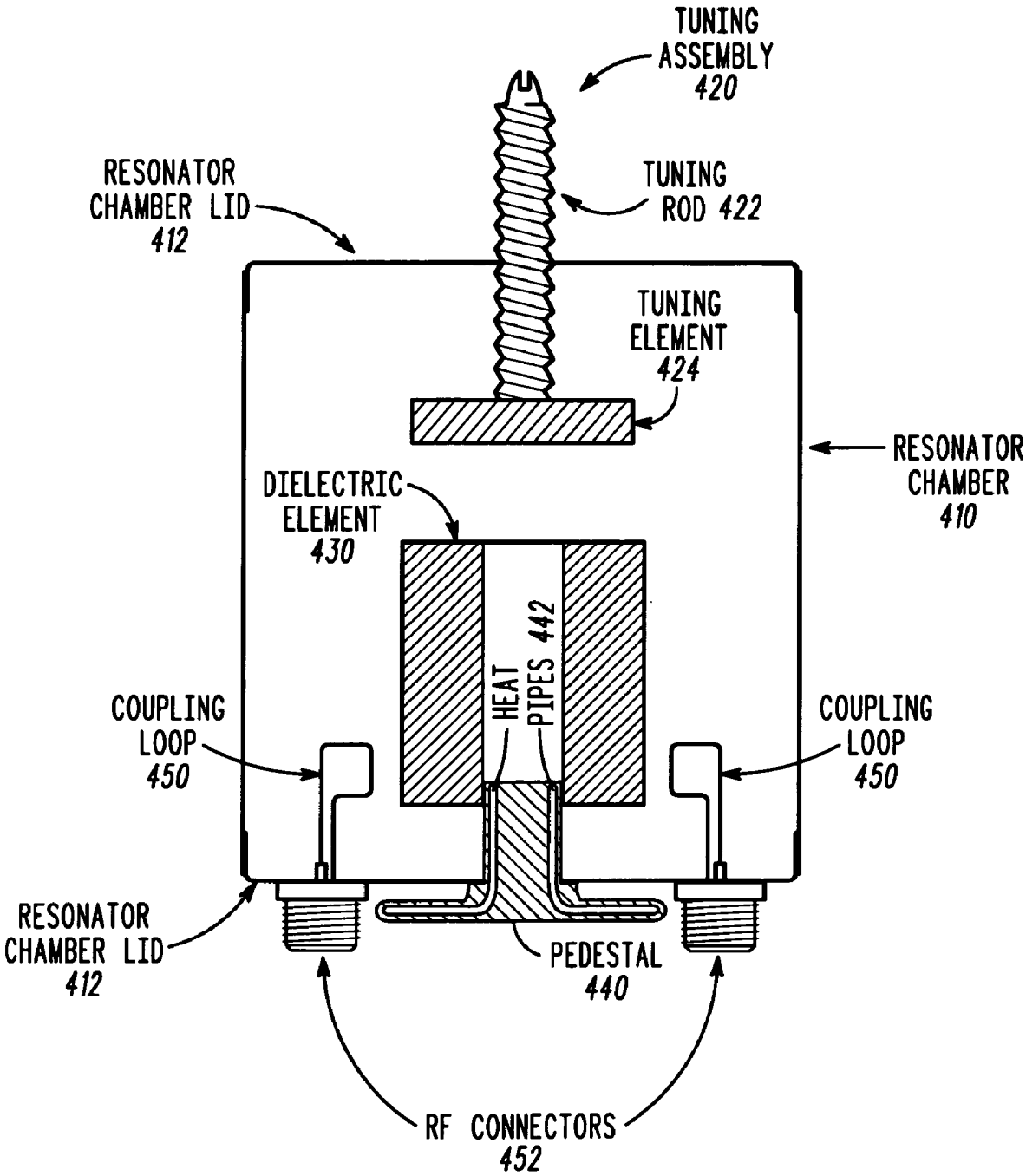
FIG. 4 illustrates a cross-sectional view of an RF cavity resonator in accordance with another embodiment of the present invention.

FIG. 4 illustrates a cross-sectional view of an RF cavity resonator 400 in accordance with another embodiment of the present invention. RF cavity resonator 400 comprises a resonator chamber 410 typically having lids 412 and also ideally having coupling loops 450 and RF connectors 452 that are similar in design and functionality to the identically labeled elements in FIG. 1, and the description thereof will not be repeated here for the sake of brevity. RF cavity resonator 400 further comprises a tuning assembly 420 that includes at least the conventional elements of: a tuning rod 422 having a first end and a second end; a tuning element 424 coupled to the tuning rod 422 at the first end; a tuning rod support (not shown) surrounding at least a portion of the tuning rod 422; a locking nut (not shown) surrounding at least a portion of the tuning rod 422 and tightened against the tuning rod support for locking the tuning element 424 into place once a desired resonant frequency is reached; and a tuning knob (not shown) coupled to the tuning rod 422 at the second end for adjusting the tuning element 424 in and out to reach the desired resonant frequency.

RF cavity resonator 400 further includes a dielectric element 430 for concentrating the RF field in the resonator chamber and a pedestal 440 coupled to the dielectric element 430 to support this element. A portion of the pedestal 440 extends into the interior of the resonator chamber 410, which is typically the only area in which the pedestal is located. However, in accordance with the present invention, a portion of the pedestal 440 is also located external to the resonator chamber 410 to enhance heat transport as explained in more detail below. The two portions are typically formed as one piece of any suitable material using for example a casting process, but may be comprised of at least two pieces depending on the implementation.

In this embodiment, the area of greatest heat flux is typically the dielectric element. Therefore, ideally a heat transport element for this embodiment is coupled to the dielectric element. In one embodiment, at least one heat pipe 442 and preferably a plurality of heat pipes 442 are enclosed within the pedestal 440 and comprise the heat transport element for RF cavity resonator 400. Heat pipes 442 may be any suitable heat pipes having a container or housing that is ideally leak-proof, a phase-change material within the container and a means for circulating the phase change material within the housing. A detailed description of suitable heat pipes is described above by reference to FIGS. 1 and 2 and will not be repeated here for the sake of brevity. Heat pipes 442 ideally extend from one end of the pedestal 440 to the other end such that the heat pipes are oriented along the path of desired heat transport. Accordingly, a portion of the heat pipes extend into the interior of the resonator chamber 410 and a portion extend outside of the resonator chamber 410 to facilitate the transport of heat from the dielectric element 430 to, e.g., the ambient air, a heat sink, etc., located external to the resonator chamber 410.

The heat transport element of RF cavity resonator 400 also comprises an electrically conductive surface for isolating the heat pipes from the RF field contained within the resonator chamber 410. Ideally, the electrically conductive surface of the heat transfer element is the material of which at least the portion of the pedestal 440 that extends within the resonator chamber is comprised. This material may be any suitable material as described above by reference to FIG. 1, which will not be repeated here for the sake of brevity. The portion of the pedestal outside of the chamber may be comprised of the same or a different material.

Those of ordinary skill in the art will realize that instead of using heat pipes, in another embodiment of the present invention the heat transport element may be constructed by using the pedestal as a housing having one or more hallowed chambers for containing the phase change material and the means for circulating the phase change material. Therefore, the portion of the housing that extends into the resonator chamber would typically be comprised of a suitable electrically conductive material or thermally conductive material with an electrically conductive surface. Those of ordinary skill in the art will further realize that the phase change material may alternatively be one that changes its phase during the heat transport process from a solid to a liquid or from a solid to a gas. Moreover, the heat transport element for the embodiment of the present invention depicted in FIG. 4 may further be included in the tuning assembly in a manner similar to that described above by reference to FIG. 2 and FIG. 3.

Figure 5:
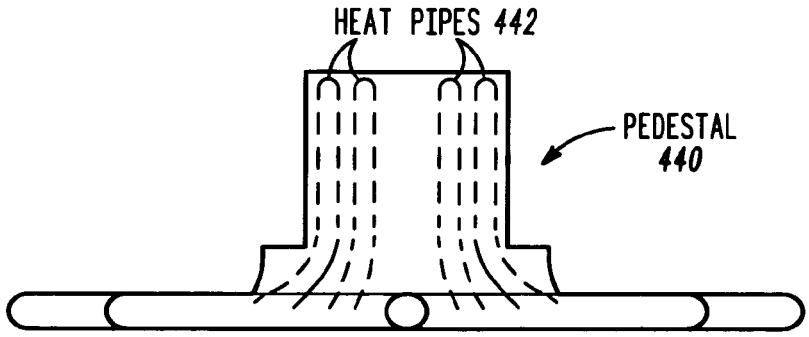
FIG. 5 illustrates a view of a dielectric pedestal for use in the RF cavity resonator of FIG. 4.
Figure 6:
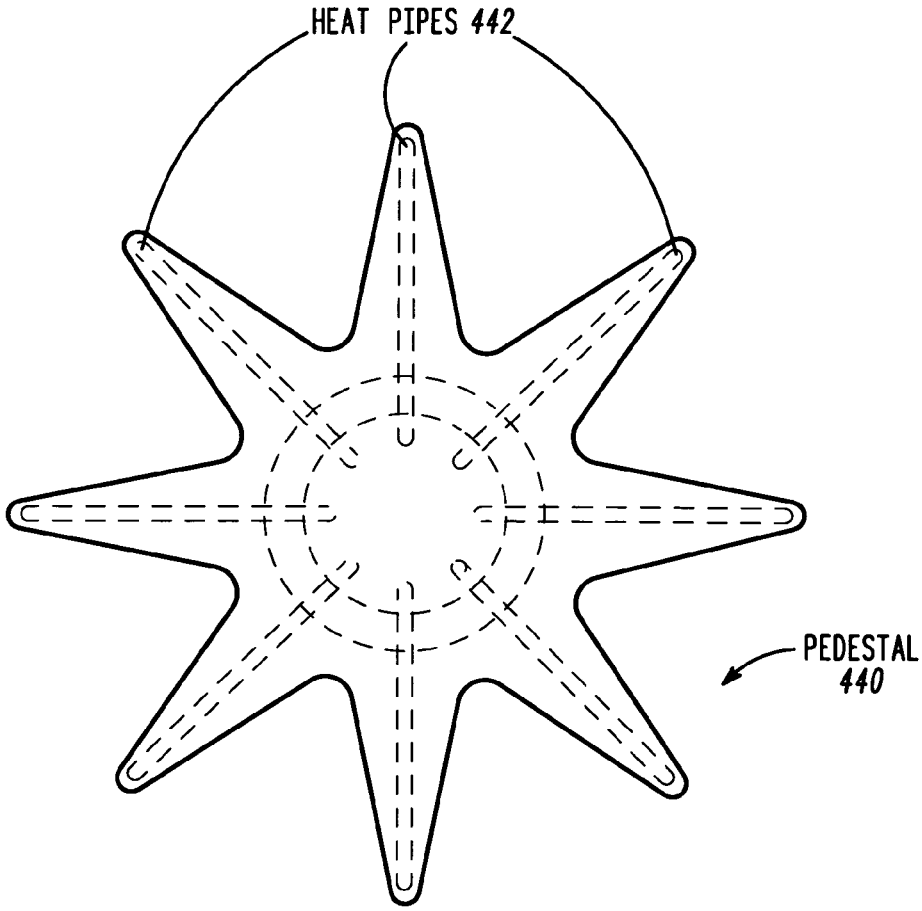
FIG. 6 illustrates a bottom side view of a dielectric pedestal for use in the RF cavity resonator of FIG. 4.

FIG. 5 illustrates a view of pedestal 440 with heat pipes 442 and FIG. 6 illustrates a bottom side view of pedestal 440 with heat pipes 442. In this embodiment, the bottom portion of pedestal 440 is ideally in the shape of tentacles to extend the surface area and provide surface contour and transitional radius for the portion of the pedestal that is located external to the resonator chamber to promote the uniform flow of ambient air over the tentacles. This enhances heat transport in a manner similar to how heat transport is enhanced using the surface expansion elements on the locking nut, as described above by reference to FIGS. 2 and 3. Ideally the heat pipes extend from the top of the pedestal into the tentacles at the bottom of the pedestal for maximum heat transport.

Figure 7:
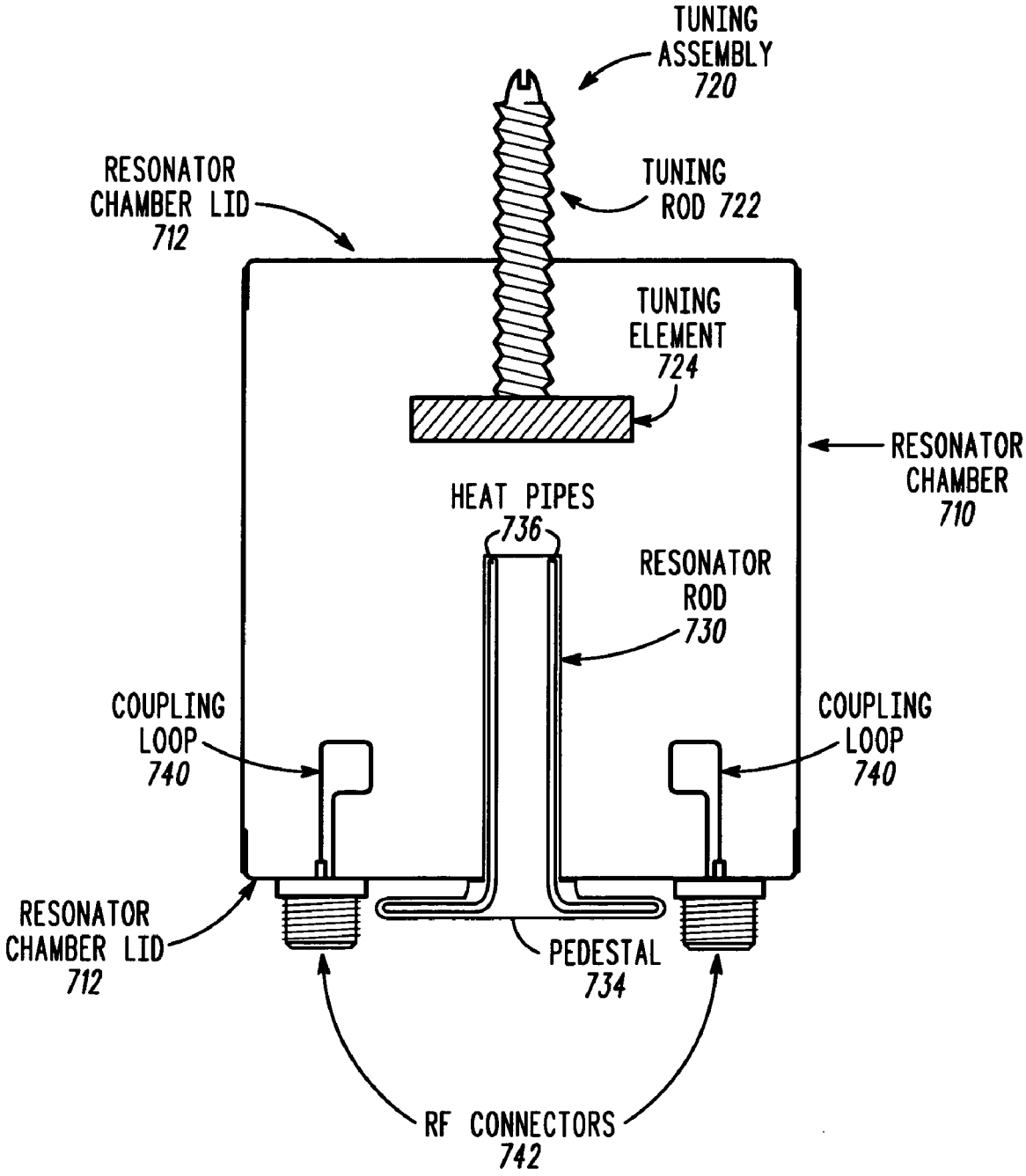
FIG. 7 illustrates a cross-sectional view of an RF cavity resonator in accordance with another embodiment of the present invention.

FIG. 7 illustrates a cross-sectional view of an RF cavity resonator 700 in accordance with another embodiment of the present invention. RF cavity resonator 700 comprises a resonator chamber 710 typically having lids 712 and also ideally having coupling loops 740 and RF connectors 742 that are similar in design and functionality to the identically labeled elements in FIG. 1, and the description thereof will not be repeated here for the sake of brevity. RF cavity resonator 700 further comprises a tuning assembly 720 that includes at least the conventional elements of: a tuning rod 722 having a first end and a second end; a tuning element 724 coupled to the tuning rod 722 at the first end; a tuning rod support (not shown) surrounding at least a portion of the tuning rod 722; a locking nut (not shown) surrounding at least a portion of the tuning rod 722 and tightened against the tuning rod support for locking the tuning element 724 into place once a desired resonant frequency is reached; and a tuning knob (not shown) coupled to the tuning rod 722 at the second end for adjusting the tuning element 724 in and out to reach the desired resonant frequency.

RF cavity resonator 700 further includes a resonator rod 730 for concentrating the RF field in the resonator chamber. The resonator rod 730 extends into the interior of the resonator chamber 710. In accordance with the present invention, RF cavity resonator 700 also includes a pedestal 734 coupled to resonator rod 730 and that is located external to the resonator chamber 710 to enhance heat transport as explained in more detail below. The resonator rod 730 and the pedestal 734 are typically formed as one piece of any suitable material using for example a casting process, but may be comprised of at least two pieces depending on the implementation. Moreover, the pedestal 734 is ideally shaped similar to the shape of the portion of pedestal 440 (of FIG. 4) that is external to resonator chamber 410 and that is described in detail above by reference to FIGS. 5 and 6, which will not be repeated here for the sake of brevity.

In this embodiment, the area of greatest heat flux is typically the resonator rod. Therefore, ideally a heat transport element for this embodiment is coupled to the resonator rod. In one embodiment, at least one heat pipe 736 and preferably a plurality of heat pipes 736 are enclosed within the resonator rod 730 and the pedestal 734 and comprise the heat transport element for RF cavity resonator 700. Heat pipes 736 may be any suitable heat pipes having a container or housing that is ideally leak-proof, a phase-change material within the container and a means for circulating the phase change material within the housing. A detailed description of suitable heat pipes is described above by reference to FIGS. 1 and 2 and will not be repeated here for the sake of brevity. Heat pipes 736 ideally extend from the top end of resonator rod 730 to the bottom end of pedestal 734 such that the heat pipes are oriented along the path of desired heat transport. Accordingly, a portion of the heat pipes extend into the interior of the resonator chamber 710 and a portion extend outside of the resonator chamber 710 to facilitate the transport of heat from the resonator rod 730 to, e.g., the ambient air, a heat sink, etc., located external to the resonator chamber 710.

The heat transport element of RF cavity resonator 700 also comprises an electrically conductive surface for isolating the heat pipes from the RF field contained within the resonator chamber 710. Typically, the electrically conductive surface of the heat transport element is the material of which resonator rod 730 is comprised. This material may be any suitable material as described above by reference to FIG. 1, which will not be repeated here for the sake of brevity. The pedestal 734 outside of the chamber may be comprised of the same or a different material.

Those of ordinary skill in the art will realize that instead of using heat pipes, in another embodiment of the present invention the heat transport element may be constructed by using, for example, the resonator rod and the pedestal as a housing having one or more hallowed chambers for containing the phase change material and the means for circulating the phase change material. Therefore, the portion of the housing that extends into the resonator chamber would typically be comprised of a suitable electrically conductive material or any thermally conductive material with an electrically conductive surface. Those of ordinary skill in the art will further realize that the phase change material may alternatively be one that changes its phase during the heat transport process from a solid to a liquid or from a solid to a gas. Moreover, the heat transport element for the embodiment of the present invention depicted in FIG. 7 may further be included in the tuning assembly in a manner similar to that described above by reference to FIG. 2 and FIG. 3.

While the invention has been described in conjunction with specific embodiments thereof, additional advantages and modifications will readily occur to those skilled in the art. The invention, in its broader aspects, is therefore not limited to the specific details, representative apparatus, and illustrative examples shown and described. Various alterations, modifications and variations will be apparent to those skilled in the art in light of the foregoing description. Thus, it should be understood that the invention is not limited by the foregoing description, but embraces all such alterations, modifications and variations in accordance with the spirit and scope of the appended claims.

What is claimed is:

1. A radio frequency (RF) cavity resonator comprising:

a resonator chamber for containing an RF field;

an RF coupling element coupled to the resonator chamber for introducing the RF field into and extracting the RF field from the resonator chamber;

a tuning assembly for causing the RF field to resonate at a desired frequency, wherein at least a portion of the tuning assembly is coupled within the resonator chamber; and a heat transport element for transporting heat from the RF cavity resonator, wherein at least a portion of the heat transport element is coupled within the resonator chamber, the heat transport element comprising a phase change material, a housing for enclosing the phase change material, means for circulating the phase change material within the housing, and an electrically conductive surface for isolating the phase change material from the RF field, wherein the phase change material undergoes a phase change during circulation within the housing.

2. The RF cavity resonator of claim 1, wherein the heat transport element comprises at least one heat pipe.

3. The RF cavity resonator of claim 1, wherein the phase change material is one of water, Freon, ammonia, and a glycol formulation.

4. The RF cavity resonator of claim 1, wherein the means for circulating is a capillary feed device.

5. The RF cavity resonator of claim 4, wherein the capillary feed device is a wicking device.

6. The RF cavity resonator of claim 1, wherein the electrically conductive surface is at least one of a metal, metal alloys and metallized plastic.

7. The RF cavity resonator of claim 1 further comprising:

a dielectric element within the resonator chamber for concentrating the RF field; and a pedestal having a portion within the resonator chamber and coupled to the dielectric element for supporting the dielectric element, wherein the heat transport element is included in the pedestal.

8. The RF cavity resonator of claim 1, wherein at least a portion of the housing for containing the phase change material is comprised of the electrically conductive surface.

9. The RF cavity resonator of claim 7, wherein the tuning assembly comprises:

a tuning rod having a first end and a second end;

a tuning element coupled within the resonator chamber to the tuning rod at the first end;

a tuning rod support surrounding at least a portion of the tuning rod;

a locking nut surrounding at least a portion of the tuning rod and tightened against the tuning rod support; and a tuning knob coupled to the tuning rod at the second end, wherein the heat transport element is included in at least one of the tuning element, the tuning rod support, the locking nut, the tuning knob and the tuning rod.

10. The RF cavity resonator of claim 9, wherein:

the locking nut includes a top surface, a bottom surface and a plurality of surface expansion elements;

the tuning rod support is tightened against the top surface; and the plurality of surface expansion elements are at least one of: coupled through the top and bottom surfaces, and coupled to at least one of the top surface and the bottom surface.

11. The RF cavity resonator of claim 1 further comprising:

a resonator rod coupled within the resonator chamber; and a pedestal coupled to the resonator rod, wherein the heat transport element is included in the resonator rod and the pedestal.

12. The RF cavity resonator of claim 1, wherein the tuning assembly comprises:

a tuning rod having a first end and a second end;

a tuning element coupled within the resonator chamber to the tuning rod at the first end; and a motor element for moving the tuning element in and out within the resonator chamber, wherein the heat transport element is included in at least the tuning rod.

13. The RF cavity resonator of claim 1, wherein the RF coupling element comprises one of:

at least one RF coupling loop and at least one RF connector coupled to the RF coupling loop;

at least one microstrip element and at least one RF connector coupled to the microstrip element; and aperture-coupled elements.

14. A radio frequency (RF) cavity resonator comprising:

a resonator chamber for containing an RF field;

an RF coupling element coupled to the resonator chamber for introducing the RF field into and extracting the RF field from the resonator chamber;

a tuning assembly for causing the RF field to resonate at a desired frequency, wherein at least a portion of the tuning assembly is coupled within the resonator chamber;

a dielectric element within the resonator chamber for concentrating the RF field;

a pedestal having a portion within the resonator chamber and coupled to the dielectric element for supporting the dielectric element; and a heat transport element included in the pedestal for transporting heat from the RF cavity resonator, the heat transport element comprising a phase change material, a housing for enclosing the phase change material, means for circulating the phase change material within the housing, and an electrically conductive surface for isolating the phase change material from the RF field, wherein the phase change material undergoes a phase change during circulation within the housing.

15. The RF cavity resonator of claim 14, wherein the heat transport element comprises at least one heat pipe.

16. The RF cavity resonator of claim 14, wherein at least a portion of the housing for containing the phase change material is comprised of the electrically conductive surface.

* * * * *